US011332993B2

(12) United States Patent
Oag et al.

(10) Patent No.: US 11,332,993 B2
(45) Date of Patent: May 17, 2022

(54) CUTTING TOOL

(71) Applicant: Spex Engineering (UK) Limited, Aberdeen (GB)

(72) Inventors: Jamie Oag, Aberdeenshire (GB); Rae Younger, Aberdeenshire (GB); Andrew Pettitt, Aberdeenshire (GB); Barry Chapman, Aberdeenshire (GB); Simon McKay, Aberdeenshire (GB); David James Wilkie, Aberdeenshire (GB); Sidney Dantuma Johnston, Aberdeenshire (GB); John Fox, Aberdeenshire (GB)

(73) Assignee: SPEX CORPORATE HOLDINGS LIMITED, Aberdeen (GB)

( * ) Notice: Subject to any disclaimer, the term of this patent is extended or adjusted under 35 U.S.C. 154(b) by 0 days.

(21) Appl. No.: 16/731,343

(22) Filed: Dec. 31, 2019

(65) Prior Publication Data

US 2020/0131876 A1 Apr. 30, 2020

Related U.S. Application Data

(63) Continuation of application No. 15/522,166, filed as application No. PCT/GB2015/053226 on Oct. 27, 2015, now Pat. No. 10,550,656.

(30) Foreign Application Priority Data

Oct. 28, 2014 (GB) ..... 1419168
Oct. 28, 2014 (GB) ..... 1419189

(51) Int. Cl.
*E21B 29/02* (2006.01)

(52) U.S. Cl.
CPC ..... *E21B 29/02* (2013.01)

(58) Field of Classification Search
CPC ..... E21B 29/02
See application file for complete search history.

(56) References Cited

U.S. PATENT DOCUMENTS 2,327,340 A * 8/1943 Couch ..... E21B 43/116 175/4.56
2,684,030 A * 7/1954 Muskat ..... E21B 29/02 102/307

(Continued)

FOREIGN PATENT DOCUMENTS

GB 2 175 674 A 12/1986
GB 2530551 A 3/2016

OTHER PUBLICATIONS

Dictionary definition of "oblique", accessed Jan. 2, 2021 via thefreedictionary.com.*

(Continued)

*Primary Examiner* — Blake Michener
(74) *Attorney, Agent, or Firm* — Tarolli, Sundheim, Covell & Tummino LLP

(57) ABSTRACT

A tool for penetrating a tubular as described. The tool comprises at least one length of linear shaped charge, a carrier adapted to support the/each length of linear shaped charge, and at least one detonation mechanism for detonating the/each length of linear shaped charge. Upon detonation of the/each length of linear shaped charge, a length of material is projected outwardly from the/each length of linear shaped charge towards an internal surface of die tubular, which is thereby penetrated. The at least one length of linear shaped charge is arranged such that, upon detonation, the trajectory of at least one portion of the projected material intersects the trajectory of at least one other portion of projected material at or adjacent the internal surface of the tubular.

16 Claims, 12 Drawing Sheets

(56) References Cited

U.S. PATENT DOCUMENTS

| | | | |
|---|---|---|---|
| 2,690,123 | A | 9/1954 | Kanady |
| 2,758,543 | A | 8/1956 | Grandin |
| 6,729,406 | B1 | 5/2004 | Collins et al. |
| 2005/0194146 | A1 | 9/2005 | Barker et al. |
| 2017/0030162 | A1 | 2/2017 | Carragher |

OTHER PUBLICATIONS

International Search Report and Written Opinion for corresponding PCT Application No. PCT/GB2015/053226.
Search Report for corresponding Great Britain Application No. GB1518999.6.

* cited by examiner

CUTTING TOOL

RELATED APPLICATIONS

The present invention is a Continuation of U.S. application Ser. No. 15/522,166 filed on 26 Apr. 2017, which is a U.S. National Stage under 35 USC 371 patent application, claiming priority to Serial No. PCT/GB2015/053226, filed on 27 Oct. 2015; which claims priority from GB 1419168.8, filed 28 Oct. 2014; and GB 1419189.4, filed 28 Oct. 2014, the entirety of all of which are incorporated herein by reference.

FIELD OF THE INVENTION

The present invention relates to the field of tools for cutting a tubular. The present invention finds particular application in the oil and gas extraction industry and some embodiments are suitable for penetrating, cutting and/or removing portions of tubulars such as casing and tubing that have already been cemented and/or fixed in place in a well/wellbore, for example to aid in the permanent sealing of wells which are to be abandoned. The present invention may find application in other situations in which a tubular or other metallic profile is to be cut or pre-fragmented. It will be understood that embodiments of the present invention can be used to cut non-metallic objects too.

BACKGROUND TO THE INVENTION

There are many situations in which it is desirable to remove a portion of casing from an oil or gas well. Current Oil and Gas UK Guidelines for the Abandonment of Wells (July 2015, Issue 5) dictate that a permanent barrier, typically a cement plug, must be formed between the reservoir and the seabed to act as one of a number of permanent barriers when a well is abandoned or plugged. This measure is intended to isolate the well and reduce the possibility of pressure migration in order to prevent hydrocarbons and other fluids from reservoirs coming to surface and spilling into the sea.

In some situations, prior to installing the cement plug to abandon or plug the well, it may be necessary to remove downhole installations such as production tubing, casing and other downhole tubulars, and the cement or other downhole fixings that secure the downhole installation to the bedrock. In some cases, where cemented casing is used, for example, there may be a leak path in the cement behind the casing or between casing layers. Rectifying such a breach may also require the removal of a casing section and associated cement before forming the cement plug with new cement.

Conventional removal of cemented casing uses, for example, milling tools or hydro-abrasive cutters which remove the metallic casing by gradually cutting or milling away small portions of metal and cement. These are slow processes and therefore make such an operation very expensive and time consuming.

SUMMARY OF THE INVENTION

According to a first aspect of the present invention there is provided a tool for penetrating a tubular, the tool comprising:

at least one length of linear shaped charge, a carrier adapted to support the/each length of linear shaped charge, and at least one detonation mechanism for detonating the/each length of linear shaped charge such that, upon detonation of the/each length of linear shaped charge, a length of material is projected outwardly from the/each length of linear shaped charge towards an internal surface of the tubular, which is thereby penetrated;

wherein the at least one length of linear shaped charge is arranged such that, upon detonation, the trajectory of at least one portion of the projected material intersects the trajectory of at least one other portion of projected material at or adjacent the internal surface of the tubular.

In at least one embodiment of the present invention a tool as described above is able to fragment or pre-fragment a section of a tubular casing due to the fact that at least two portions of linear shaped charge project material in two linear distributions, the trajectories of which intersect and define at least a completely fragmented or pre fragmented shape on the casing by completely or partially penetrating the internal surface of the tubular. The fragmented or pre-fragmented section of tubular is then removed easily from the sides of the borehole and can be left to fall or retrieved to surface.

A linear shaped charge has a lining typically with V-shaped profile (other profiles can also be used, such as W-shaped), the lining is surrounded by an explosive material and may be encased with a suitable material that serves to protect the explosive material and to confine it on detonation.

In the present invention, upon detonation of the linear shaped charge the outwardly projected length of material is the lining of the linear shaped charge in the form of a high velocity cutting plane. The outwardly projected material penetrates the tubular by plastically displacing the material of the tubular, whilst simultaneously imparting a shock into the tubular and the cement behind the tubular. The lining conventionally comprises copper. However, alternatively or additionally the lining may comprise lead, tungsten, glass or any other suitable material or combination of materials.

The tubular may be partially penetrated by the outwardly projected material of the linear shaped charge.

Partial penetration of the tubular may create lines of weakness in the tubular.

In some embodiments, a shockwave created by the detonation of the/each linear shaped charge fractures the tubular along the line of weakness generated by the partial penetration of the tubular by the outwardly projected material.

Alternatively or additionally, the tubular may be completely penetrated by the outwardly projected material.

In some embodiments of the present invention, the outwardly projected material penetrates beyond the tubular. In some embodiments the outwardly projected material may penetrate cement or other fixings securing the tubular to another tubular and/or to the bedrock.

In these and other embodiments a shockwave created by the detonation of the/each linear shaped charge fractures cement or other fixings securing the tubular to another tubular and/or to the bedrock. Behind the outwardly projected material, the detonation creates a shockwave. The shockwave can completely fracture the tubular and, in some embodiments, pull the fractured portions of the tubular into the borehole.

At least one portion of the/each length of linear shaped charge may be arranged to, individually or in combination, cause penetrations that define closed areas or shapes on the surface of the tubular. In at least one embodiment of the present invention by creating penetrations, either partial or complete, that define closed areas on the internal surface of the casing, the casing is fragmented or pre-fragmented into smaller pieces which are easier to remove from the cement and may be left to fall downhole or be retrieved.

In the preferred embodiment, at least one portion of at least one length of linear shaped charge may be arranged to cause a lattice of penetrations on the surface of the tubular.

In this embodiment, the tool may comprise a plurality of linear shaped charges helically wound around the carrier.

The plurality of linear shaped charges may be helically wound clockwise and counter-clockwise around the carrier to create a lattice.

In these or alternative embodiments, at least one portion of at least one length of linear shaped charge may be arranged to cause straight penetrations on the internal surface of the tubular. In at least one embodiment of the present invention by creating straight vertical penetrations on the surface of the tubular, the tubular can be fragmented into bands or strips that are removed more easily than a tubular portion of casing.

Alternatively or additionally at least one portion of at least one length of linear shaped charge may be arranged to cause curved penetrations, either horizontal or oblique, a spiral, helical or other geometrically shaped penetration or a scroll penetration on the surface of the tubular.

At least one portion of a length of linear shaped charge may overlap another portion of the same linear shaped charge or a portion of another linear shaped charge.

In alternative or additional embodiments, at least one portion of a length of linear shaped charge may butt against another portion of the same linear shaped charge or a portion of another linear shaped charge.

At least a portion of at least one length of linear shaped charge may be oriented such that outwardly projected material is projected perpendicular to the surface of the tubular.

At least a portion of at least one length of linear shaped charge may be oriented such that outwardly projected material is projected obliquely to the surface of the tubular.

In at least one embodiment of the present invention, by combining oblique and perpendicular charges it is possible to detonate more than one linear charge onto the same location on the tubular surface. In this way, an increased penetration can be achieved.

Where there are a plurality of linear shaped charges, at least two of linear shaped charges may be detonated substantially simultaneously. Simultaneous detonation increases the penetration capacity of the tool Alternatively or additionally, where there are a plurality of linear shaped charges at least two of linear shaped charges may be detonated consecutively. In at least one embodiment of the present invention a tool comprising a sequenced detonation mechanism can achieve the desired results by penetrating the casing which has been previously weakened by previous detonations, for example by cumulative targeting at the same locations or by successive targeting at adjacent locations. In some embodiments, particularly where there are a combination of charge orientations, it may be desirable to have a time interval between detonations to achieve an effect. For example, where there are a combination of charge orientations, directed to the same location, the first linear shaped charge could be detonated and create a cut through the tubular and then, subsequently, a second linear shaped charge could be detonated onto the same location to break the cement behind the tubular into rubble.

The/each detonation mechanism may be triggered by an initiator.

The initiator may be activated electrically, mechanically, acoustically, optically, hydraulically or by direct pressure or differential pressure or sonar, or by some combination of these The/each detonation mechanism may be adapted to detonate the/each length of linear shaped charge consecutively and starting simultaneously at both ends towards the centre.

The/each detonation mechanism may be adapted to detonate the/each length of linear shaped charge consecutively and starting at a middle point towards one or both ends.

The carrier may be cylindrical and elongated. In at least one embodiment of the present invention a cylindrical and elongated carrier is the most suitable shape for deploying the tool into an oil or gas well.

The carrier may be configurable between a first position in which the tool defines a reduced diameter and a second position in which the tool defines a larger diameter. A tool of this type may be useful in the first position to pass restrictions which may exist in, for example, a wellbore through which the tool has to pass.

In the larger diameter second position, the carrier may bring the/each linear shaped charge to a predetermined distance from the tubular surface. Selecting the optimum distance between the/each linear shaped and the tubular, dependent on conditions within the tubular, helps maximise the cutting performance of the linear shaped charge.

The carrier may be a lattice.

Where the carrier is a lattice, the carrier may be movable between the first and second positions by twisting, axial compression or tension or other means with a similar effect.

In other embodiments, the expansion may be achieved by inflation, unrolling or fluid injection.

The carrier may be reused after detonating the/each length of linear shaped charge.

Alternatively the carrier may be disposable. In at least one embodiment of the present invention the carrier is shattered by the detonation energy and falls downhole in small pieces. A disposable carrier may be of advantage because there is no need to retrieve it to surface anymore after it has been used and therefore a less time consuming operation is required.

The carrier may comprise a material which shatters after detonation.

Alternatively or additionally the carrier may comprise Bakelite™, a phenolic material, a propellant, a glass, a ceramic material, a plastic, a flexible material or any other suitable material or combination of materials.

Alternatively or additionally the carrier may comprise a high strength material, such as steel, carbon fibre or special alloys etc. In at least one embodiment of the present invention a carrier made of high strength material can be recovered after use and therefore the cost of the operation is reduced.

In other embodiments the carrier may be adapted to provide functionality post detonation, such as taking measurements.

The carrier may comprise a combustible material, such as propellant, which, in use, can be initiated to produce heat and gas which could further assist the penetration process.

The carrier combustible material may be aluminium, magnesium or any suitable material.

At least one portion of the/each length of linear shaped charge may be embedded in the carrier. For example, in one embodiment, lengths of linear shaped charge may be placed in grooves milled on the surface of the carrier. In at least one embodiment of the invention, embedding a linear shaped charge in a rigid carrier provides an additional confinement to the rear portion of the linear shaped charge which serves to amplify or magnify the cutting performance of the linear shaped charge.

At least one portion of the/each length of linear shaped charge may be non-embedded in the carrier. For example, in one embodiment, lengths of linear shaped charges may be supported at their ends by the carrier. In at least one embodiment of the present invention, a carrier with non-embedded linear shaped charges may be adapted to have two configurations: a run-in configuration, wherein the carrier is in a lengthwise extended configuration and the linear shaped charges around its surface are close to the carrier central axis and a set configuration, wherein the carrier is in a lengthwise compacted configuration and the linear shaped charges are further away from the carrier central axis. In this way, it is possible to run the tool downhole easily and then bring the linear shaped charges into close proximity to the casing to increase their penetrating effect.

The tool may further comprise a tubular engagement mechanism.

The engagement mechanism may be adapted to apply a force to the tubular.

The force may be applied to the tubular after penetration by the at least one linear shaped charge.

The application of the force may detach a portion of the tubular.

The engagement means may be mechanically deployed into engagement with the tubular.

Alternatively the engagement means may be projected towards the tubular.

The engagement means may be projected by an additional shaped charge or other stored energy means.

The tubular engagement means may be utilised to centralise the tool within the tubular. Centralising is desirable to ensure the linear shaped charges are equidistant from the tubular The tool may be centralised by inflation of a bladder, Alternatively or additionally the tool may be centralised using spring steel centralises or any suitable method of centralising.

In one embodiment the engagement mechanism is rubber or foams or any suitable material.

The tool may further comprise an additional shaped charge or charges.

The additional shaped charge or charges may be non-linear or linear shaped charges.

The additional shaped charge or charges may be used to break the cement into rubble after the casing has been removed by the detonation of the linear shaped charges.

Where the linear shaped charge is a diamond or square shaped lattice formation, the additional shaped charges may be arranged to produce penetrations through the centre of the diamonds or squares.

The tool may be modular. In at least one embodiment of the present invention several modular tools can be operatively interconnected easily to form a longer modular tool such that a greater length of casing can be removed in one operation.

Where the tool is modular, one or more modules may be detonated simultaneously with at least one other module. The modules may, for example, be detonated simultaneously to remove a long section of casing.

Alternatively, where the tool is modular, one or more modules may be detonated in a sequence with at least one other module. This may be of benefit in the situation for example where the lowermost tool could be detonated first to remove a section of casing and some cement, then the string lowered, and the next tool detonated to remove additional cement in a sequential fashion.

The tool may comprise at least one mechanism for optimising the performance of the tool.

The optimising mechanism may be configured to remove environmental fluids from between the tubular and the tool. Removing environmental fluids allows an environment to be set up and for which the tool can be designed to perform optimally.

The optimising mechanism may isolate a section of the tubular. In such an embodiment once the section of tubular is sealed and liquids or other environmental fluids within the tubular surrounding the tool could be driven out using pressurised gas, a gas generator or suction for example. This would provide a more reproducible environment between the tubular and the tool.

The tool may comprise at least one plug, packer or sealing element to isolate the section of the tubular.

The optimising mechanism may drive environmental fluids from a section of tubular.

The optimising mechanism may drive environmental fluids from the section of tubular by for example expanding foam between the tool and the tubular surface. A closed cell structure, such as a foam, may be used and once ready for detonation, the linear shaped charges can be detonated to pass through the closed cell foam into the target.

The optimising mechanism may be configured to change a physical characteristic of the tubular or the cement.

The optimising mechanism may be configured to reduce the temperature of the tubular.

The optimising mechanism may use a cooling agent, for example liquid nitrogen, to reduce the temperature of the tubular by allowing the liquid nitrogen to expand into its gaseous form. Reducing the temperature of the tubular to, for example, between −40 and −70° C. will make the tubular more brittle and susceptible to penetration by the outwardly projected material of the linear shaped charges.

Additionally or alternatively, the optimising material could be an alternative and effective cooling agent such as carbon dioxide. Solid and liquid carbon dioxide will also cool metals when allowed to expand into the gaseous form.

The optimising mechanism may be adapted to release acid after detonation of the/each linear shaped charge in order to remove cement. In at least one embodiment of the present invention the tool releases an acid wash to remove any cement remaining in the borehole section that is to be repaired.

Optionally the tool may comprise a housing. In at least one embodiment of the present invention a housing protects the linear shaped charges while the tool is being run into the well.

The housing may be removable. In at least one embodiment of the present invention once the tool has reached the desired location the housing is removed to expose the linear shaped charges.

The tool may be adapted to withstand pressure and/or temperature.

The tool may be adapted to withstand well pressure and/or temperature.

Particularly the tool may be adapted to operate within high-pressure/high-temperature wells.

Where the tool comprises a housing, the housing may protect the tool from external pressure and/or temperature.

The tool may in some embodiments be pressure balanced.

The tool may be adapted to be deployed by a wireline, slickline or coil or any suitable method of deployment.

According to a second aspect of the present invention there is provided a method of penetrating a section of tubular, the method comprising:

providing a tool which comprises at least one length of linear shaped charge, a carrier adapted to support the/each length of linear shaped charge, and at least one detonation mechanism for detonating the/each length of linear shaped charge such that, upon detonation of the/each length of linear shaped charge, a length of material is projected outwardly from the/each length of linear shaped charge towards an internal surface of the tubular, which is thereby penetrated, wherein the/each length of linear shaped charge is arranged such that, upon detonation, the trajectory of at least one portion of the projected material intersects the trajectory of at least one other portion of projected material at or adjacent the internal surface of the tubular; running the tool into the tubular to a desired location; and detonating at least one portion of the/each length of linear shaped charge.

In at least one embodiment of the present invention a method of penetrating a tubular as described previously is suitable to fragment of pre-fragment the tubular into smaller pieces and therefore a section of the tubular can be removed from the whole length of tubular.

The method may comprise applying a tension to the tubular before detonating at least one portion of linear shaped charge.

Alternatively the method may comprise applying a compression to the tubular before detonating at least one portion of linear shaped charge.

The method may further comprise the step of removing fragments of casing from their original location.

The method may further comprise the step of providing cement or any suitable material to form a plug.

The method may further comprise the step of moving to a first, reduced diameter configuration.

The method may further comprise the step of moving to a second, increased diameter configuration.

According to a third aspect of the present invention there is provided a tool for penetrating an object, the tool comprising:

at least one length of linear shaped charge, a carrier adapted to support the/each length of linear shaped charge, and at least one detonation mechanism for detonating the/each length of linear shaped charge such that, upon detonation of the/each length of linear shaped charge, a length of material is projected outwardly from the/each length of linear shaped charge towards the surface of the object, which is thereby penetrated;

wherein the at least one length of linear shaped charge is arranged such that, upon detonation, the trajectory of at least one portion of the projected material intersects the trajectory of at least one other portion of projected material at or adjacent the surface of the object.

The object may be a plate. Alternatively the object may be a tubular.

The object surface may be an internal surface of a tubular.

Alternatively the object surface may be an external surface of a tubular.

The object may define a continuous surface.

Alternatively the object may define an intermittent surface. For example a sandscreen.

It will be understood that the non-essential features of one aspect of the invention may be equally applicable to another aspect of the invention and have not been repeated for brevity

BRIEF DESCRIPTION OF THE DRAWINGS

Embodiments and features of the present invention will be now described, as an example only, with reference to the following drawings, in which:

FIG. 6, comprising

FIG. 7, comprising

FIG. 8, comprising

FIG. 9, comprising

FIG. 10, comprising

FIG. 11, comprising

DETAILED DESCRIPTION OF THE DRAWINGS

Figure 1:
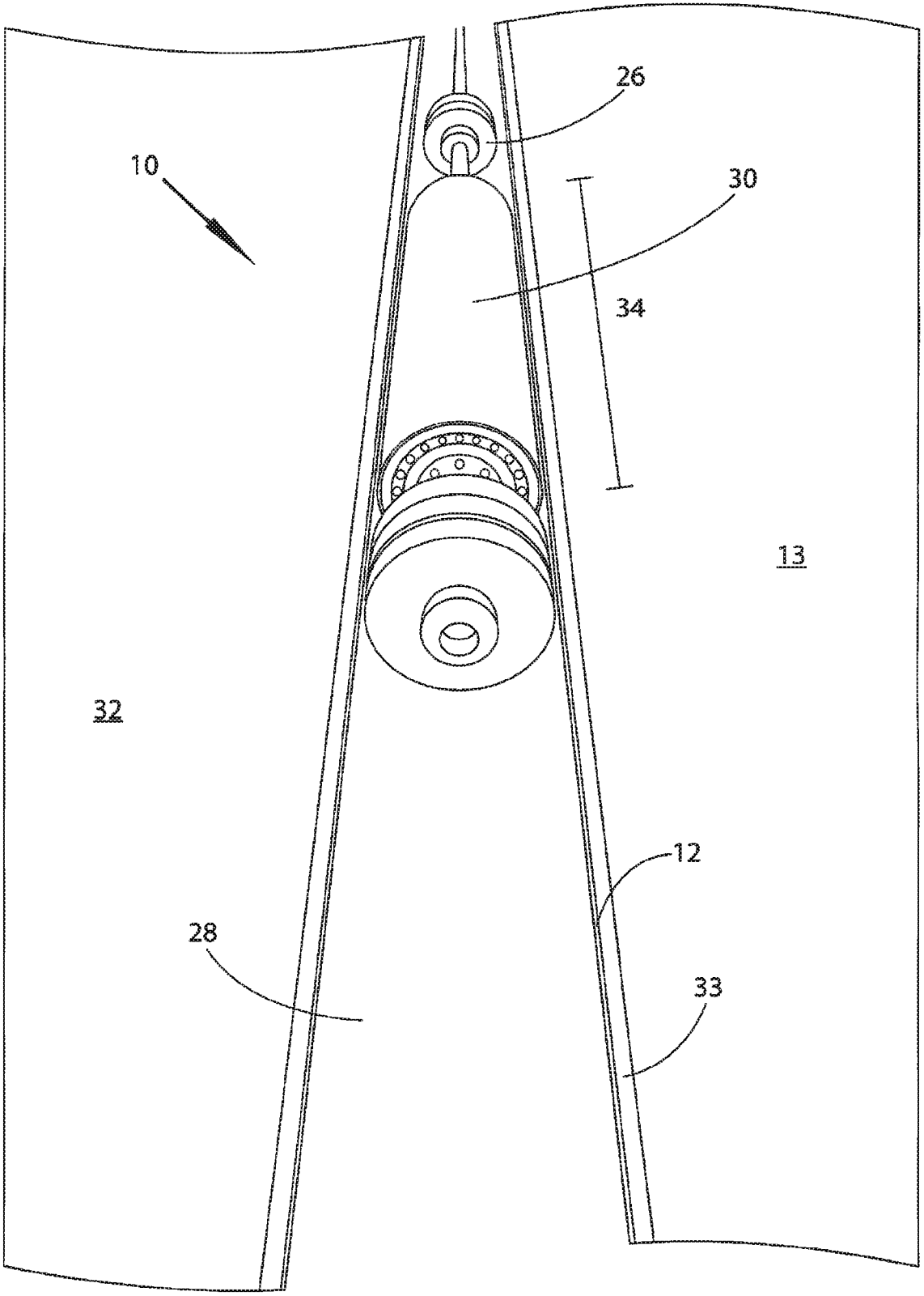
FIG. 1 is a perspective view of a tool for penetrating a well tubular cemented by means of a cement layer to the surrounding bedrock, according to a first embodiment of the present invention.
Figure 2:
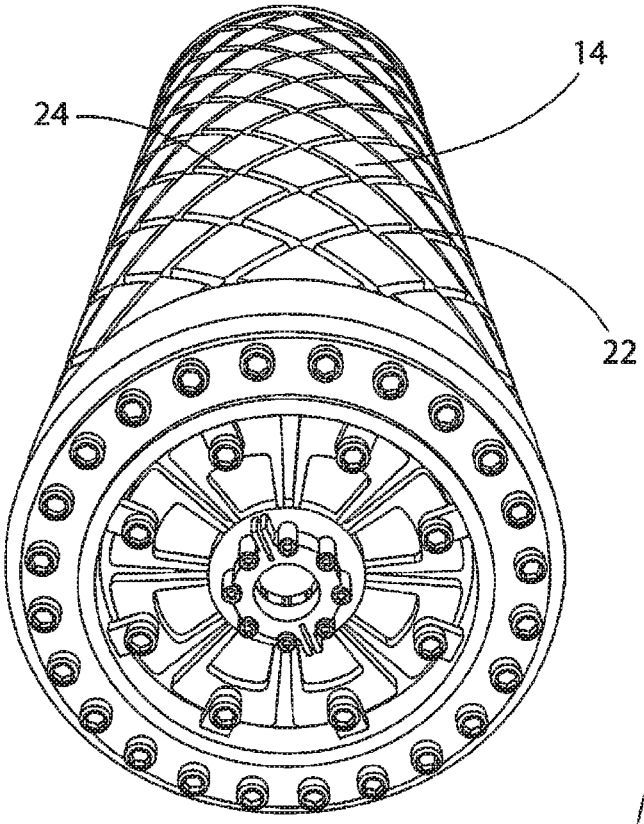
FIG. 2 is a perspective view of the carrier for the tool of FIG. 1.

Reference is first made to FIG. 1, a perspective view of a tool, generally indicated by reference numeral 10, for penetrating a well tubular 12 cemented by means of a cement layer 33 to the surrounding bedrock 32, according to a first embodiment of the present invention; FIG. 2, a perspective view of the carrier 14 for the tool 10 of FIG. 1, and FIG. 3, a perspective view of the lattice 16 of linear shaped charge 18 of the tool 10 of FIG. 1. The well tubular 12 forms part of a subsea oil well 13 which is to be abandoned and sealed.

The tool 10 comprises a number of lengths of linear shaped charge 18 (FIG. 3) arranged in a lattice 16. A cross section through a length of linear shaped charge 18 is shown in FIG. 3A. The linear shaped charge 18 comprises an explosive material 50 encased in a copper liner 52. The linear shaped charge 18 further defines a ridge 54, an internal section 56 and an external section 58. The relevance of this geometry will be described in due course.

Figure 3:
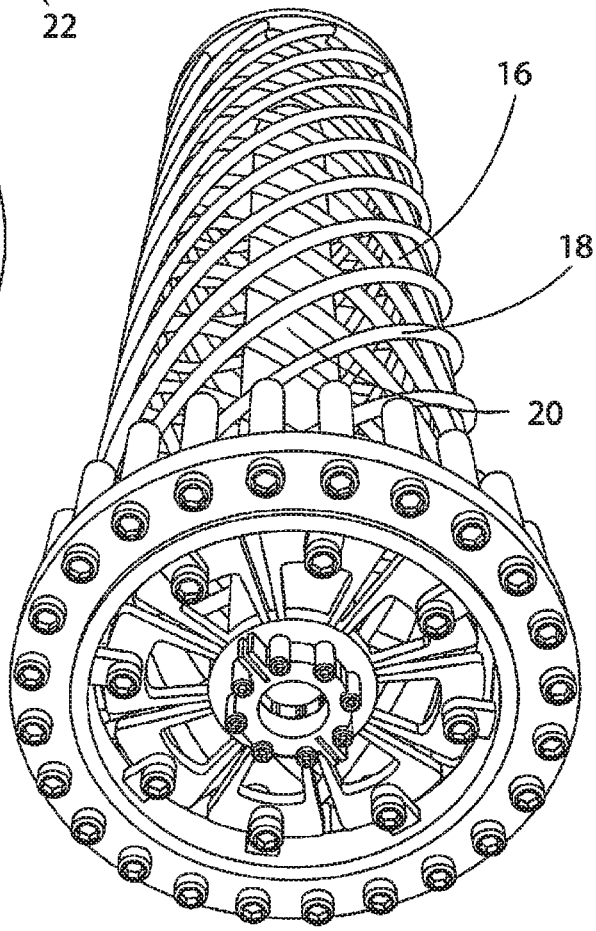
FIG. 3 is a perspective view of the lattice of linear shaped charge of the tool of FIG. 1.
Figure 3A:
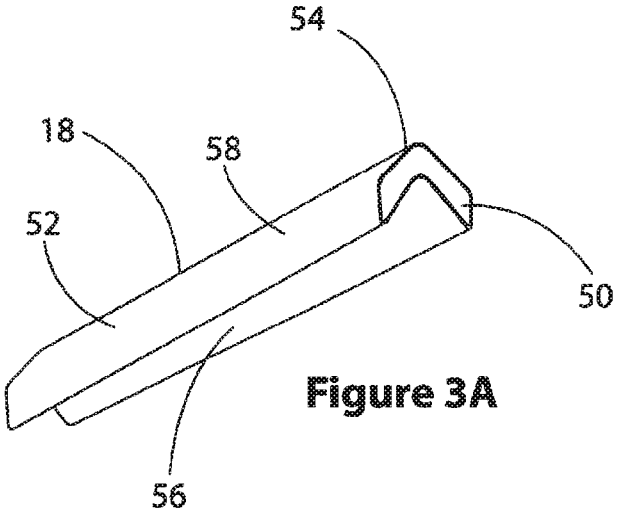
FIG. 3A is a perspective view of a portion of a length of linear shaped charge.

It can also be seen from FIG. 3 that the tool 10 further comprises a central mandrel 20 upon which the other components of the tool 10 are mounted.

Referring particularly to FIG. 2, the tool 10 further comprises a carrier 14 which defines a lattice of grooves 22 milled into the carrier surface 24. The grooves 22 are adapted to receive the linear shaped charge lattice 16 and are shaped to provide confinement to rear external section 58 of the linear shaped charge 18, serving to amplify or magnify the cutting performance of the linear shaped charge 18.

Referring to FIG. 1, the tool 10 further comprises a detonation mechanism 26 for detonating the lengths of linear shaped charge 18 such that upon detonation at the ridge 54 of the linear shaped charge 18, the explosion propagates from the ridge 54 through the explosive material 50 to the internal section 56 of linear shaped charge 18 projecting the liner 52 from the internal section 56 outwardly towards the tubular internal surface 28. This internal section of liner 56 is driven by shockwave generated by the explosive material 50.

Finally, the tool 10 further comprises a sleeve 30 adapted to protect the linear shaped charges 18 from damage and environmental fluids in the wellbore as the tool 10 travels down the tubular 12.

Figure 4:
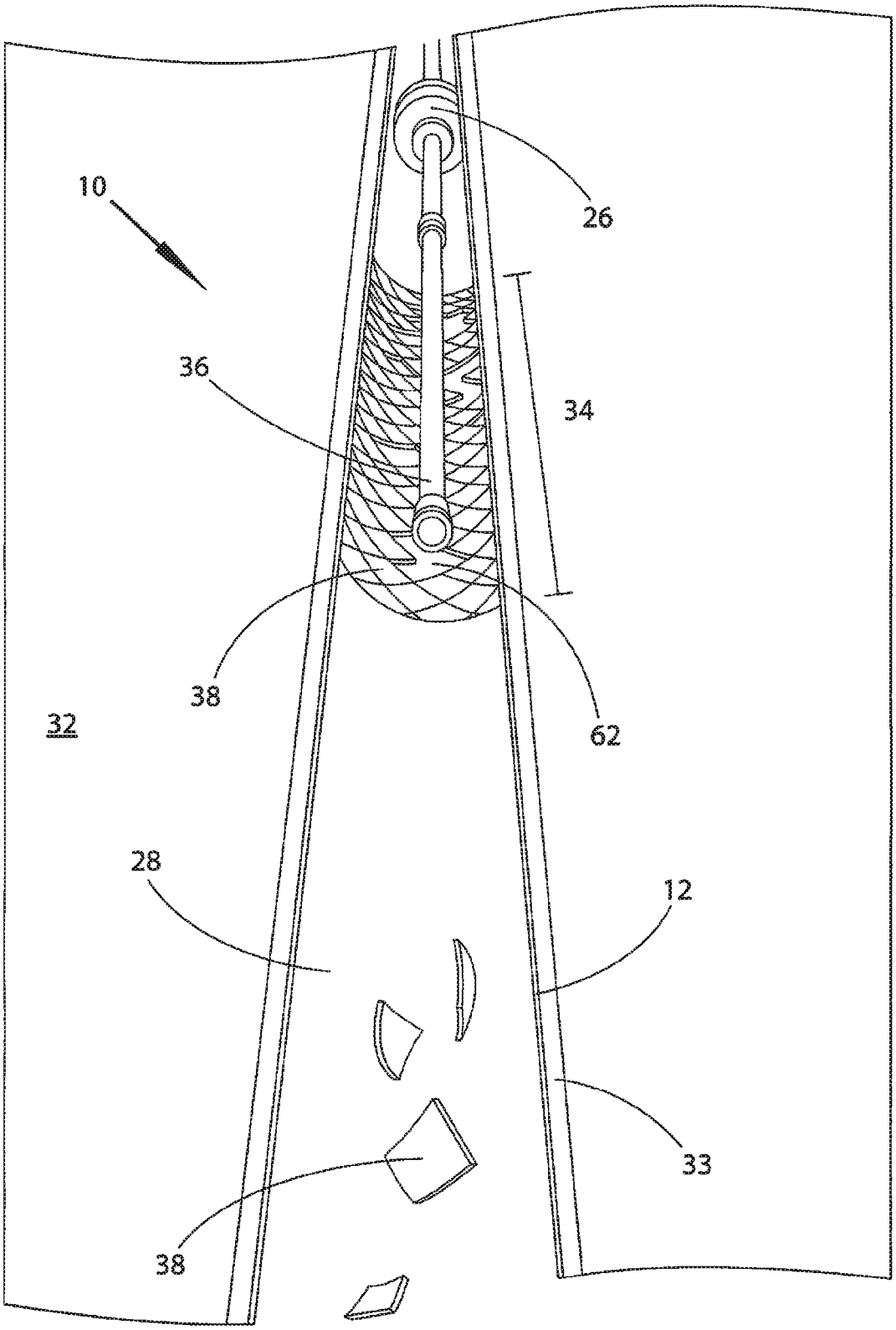
FIG. 4 is a perspective view of part of the tool of FIG. 1, following detonation of the tool and showing the tubular shortly after impact of the linear shaped charges.
Figure 5:
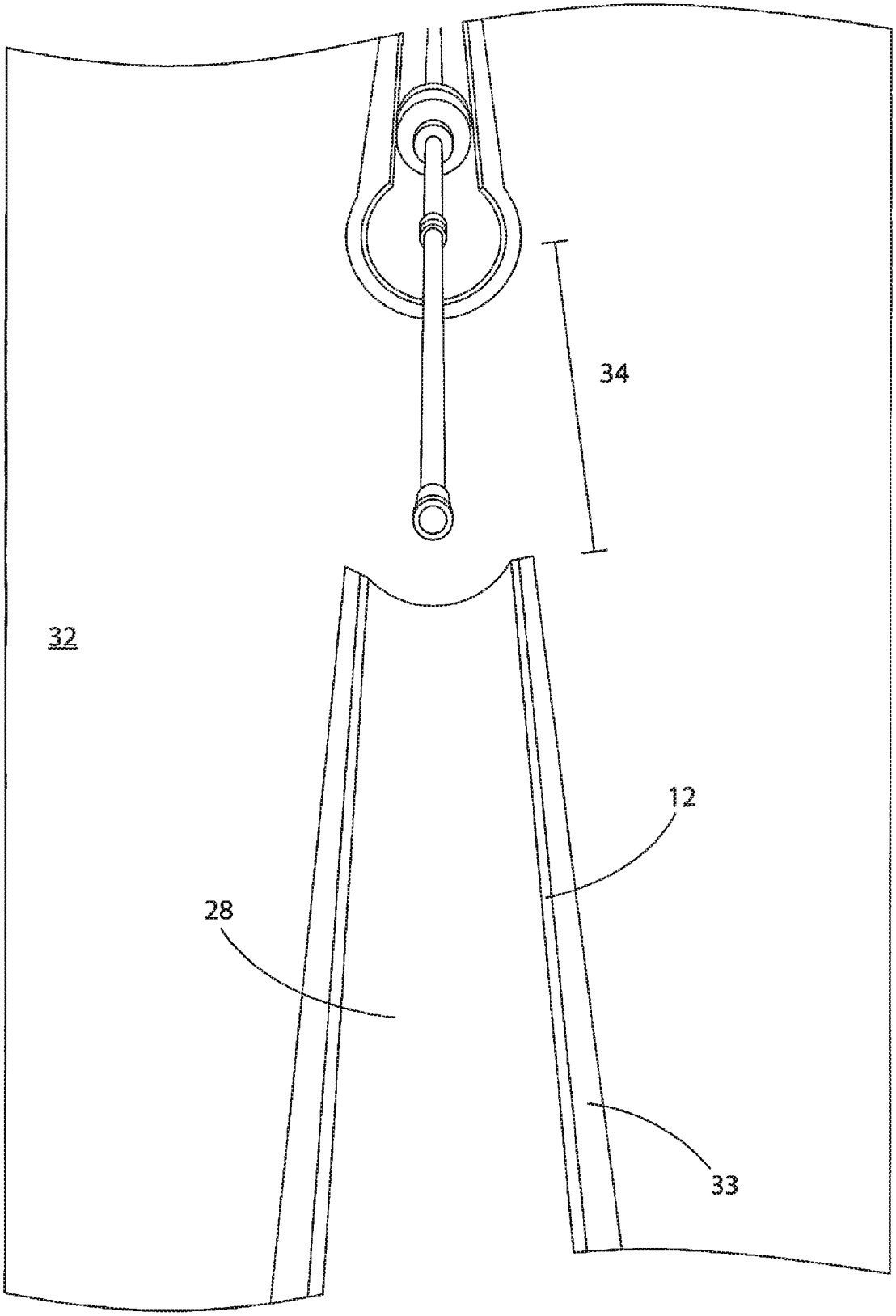
FIG. 5 is a perspective view of part of the tool of FIG. 1, following detonation of the tool and showing the tubular after impact of the liner of the linear shaped charge and impact of the shockwave generated during explosion of the linear shaped charge.

Operation of the tool 10 will now be discussed with reference to FIGS. 1, 4 and 5. FIG. 4 shows a perspective view of part of the tool 10, following detonation of the tool 10 and showing the tubular 12 shortly after impact of the linear shaped charges 18, and FIG. 5 shows a perspective view of part of the tool 10, following detonation of the tool 10 and showing the tubular 12 after impact of the liner 52 of the linear shaped charge 18 and the subsequent impact of the shockwave generated during explosion of the linear shaped charge 18.

In FIG. 1, the tool 10 has been run into position adjacent a section 34 of the tubular 12 which is to be removed along with the associated cement layer 33. Therefore the purpose of this tool 10 is to strip a section back of the well 13 to the bedrock 32. The purpose of this will be discussed in due course.

To provide an optimum environment to detonate the liner shaped charges and maximise the charges ability to cut through the tubular 12, a gas is introduced between the tool 10 and the tubular surface 28 to drive out the well fluids introduced between the tool 10 and the tubular surface 28.

Referring to FIG. 4, the sleeve 30, carrier 14 and lattice 16 have been stripped away to aid understanding of the drawing. The tool 10 is detonated and the linear shaped charges 18 project through the sleeve 30.

As a result of the detonation, the tubular internal surface 28 has been penetrated by the liner 52 of the linear shaped charge 18 resulting in a criss-cross arrangement 36 on the tubular internal surface 28. Depending on the environmental conditions, the penetrations which create the arrangement 36 can be partial penetrations into the tubular 12 or full penetrations of the tubular 12 and into the cement layer 33 behind the tubular 12.

The criss-cross arrangement 36 is created because the shaped charges 18 are arranged such that upon detonation, the trajectory of the outwardly projected material from one length of linear shaped charge 18 intersects the trajectory of the outwardly projected material from another length of linear shaped charge 18.

This detonation creates cuts in the internal surface of the tubular 12 which intersect to form diamond shape segments 38.

As previously mentioned, some of the penetrations will extend through the tubular 12 and in to the cement 33, whereas others will only partially fracture the tubular 12. As can be seen from FIG. 4, there are regions 62 of the tubular 12 where the penetration of the tubular 12 is complete and the diamond segments 38 have come away from the cement 33 and fall down the tubular 12. Immediately after the impact of the linear shaped charge liners 52, the shockwave caused by detonation of the linear shaped charges 18 will complete the fracture of the partially penetrated segments 38 and will shatter the cement 33.

Initiation of explosives creates a collapsing bubble which in turn creates a collapsing pressure. Whilst not with wishing to be bound by theory, it is believed that this collapsing pressure can assist in pulling the tubular section 34 and the associated cement 33 away from the bedrock 32 and into the tubular 12, leaving the exposed bedrock 32 (FIG. 5).

To abandon the oil well, a concrete plug is formed with the bedrock 32 at the site where the tubular section 34 was removed, and the section of tubular 12 below the plug is then sealed.

Figures 6A, 6B:
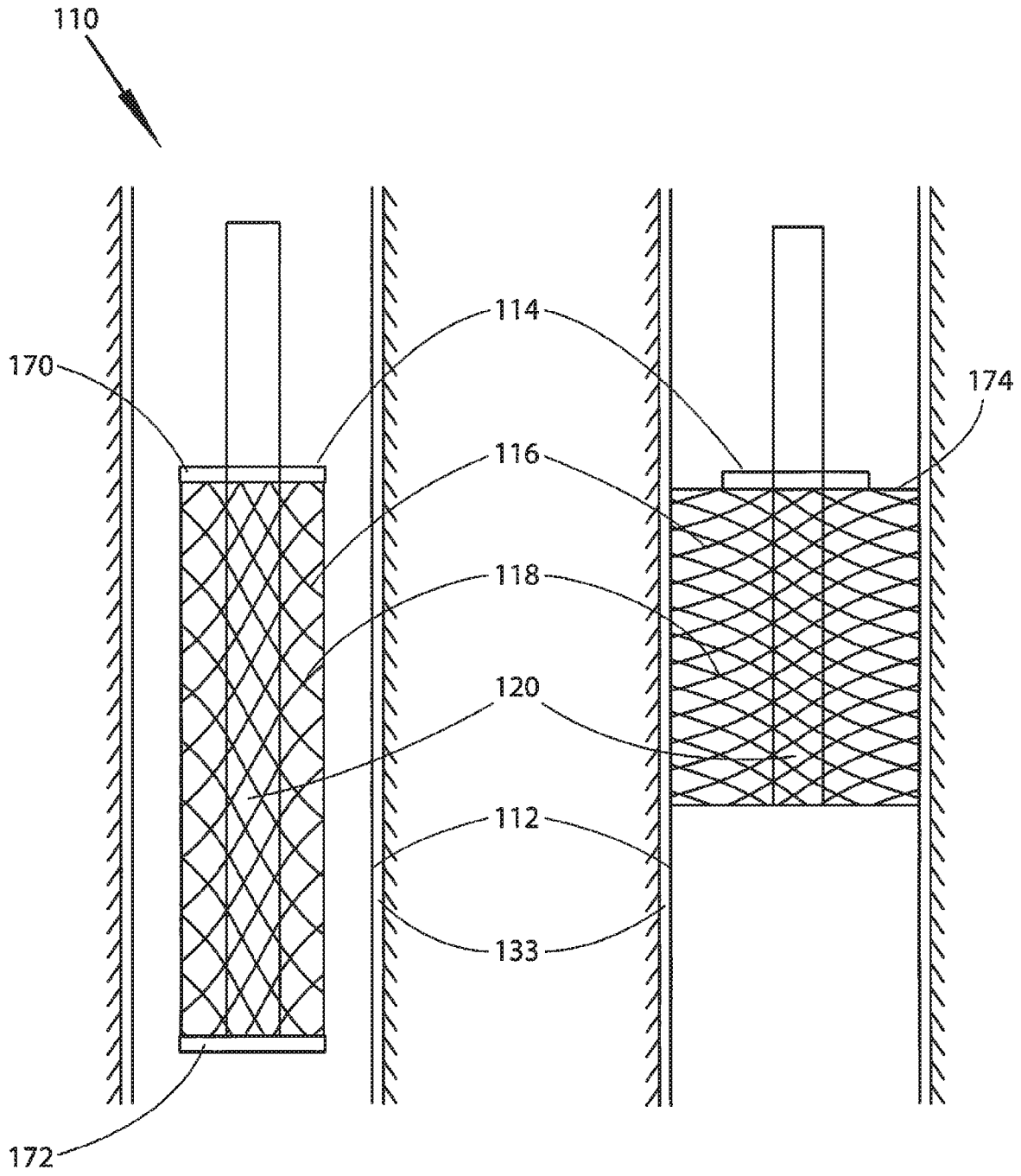
FIGS. 6A and 6B, is a series of schematic sections of a tool, in the tubular, according to a second embodiment of the present invention, the Figures illustrating a method of modifying the tool to facilitate deployment.

With reference to FIG. 6, comprising FIGS. 6A and 6B, schematic sections of a tool generally indicated by reference numeral 110 are shown in the tubular 112, according to a second embodiment of the present invention, the Figures illustrating a method of modifying the tool 110 to facilitate deployment. It will be noted that common features between this embodiment and previous embodiments of the same two digit reference numeral are preceded by the numeral 1. For clarity, the sleeve on the tool 110 is not shown.

The tool 110 comprises a lattice 116 of linear shaped charges 118 pivotally supported onto the carrier 114 which comprises a cylindrical elongated stainless steel mandrel 120 and two circular plates 170, 172 attached at each end of the mandrel. The lattice 116 is connected to the circular plates 170,172 by radially extendable supports 174.

The lattice 116 can be set in a compressed or in an extended configuration. In FIG. 6A the lattice 116 is in an extended configuration has a diameter much smaller than the diameter of the tubular 112. This permits the tool 110 to be run in to the tubular 112 past obstacles or restrictions etc. to the location where it is decided to remove the tubular 112 and the cement 133.

In FIG. 6B, the tool 110 has been radially expanded by compressing the lattice 116 between the two circular plates 170,172. The lattice expands out on the extendable supports 174 into the proximity of the tubular 112, at the optimum distance for achieving the best result.

Figures 7A, 7B, 7C:
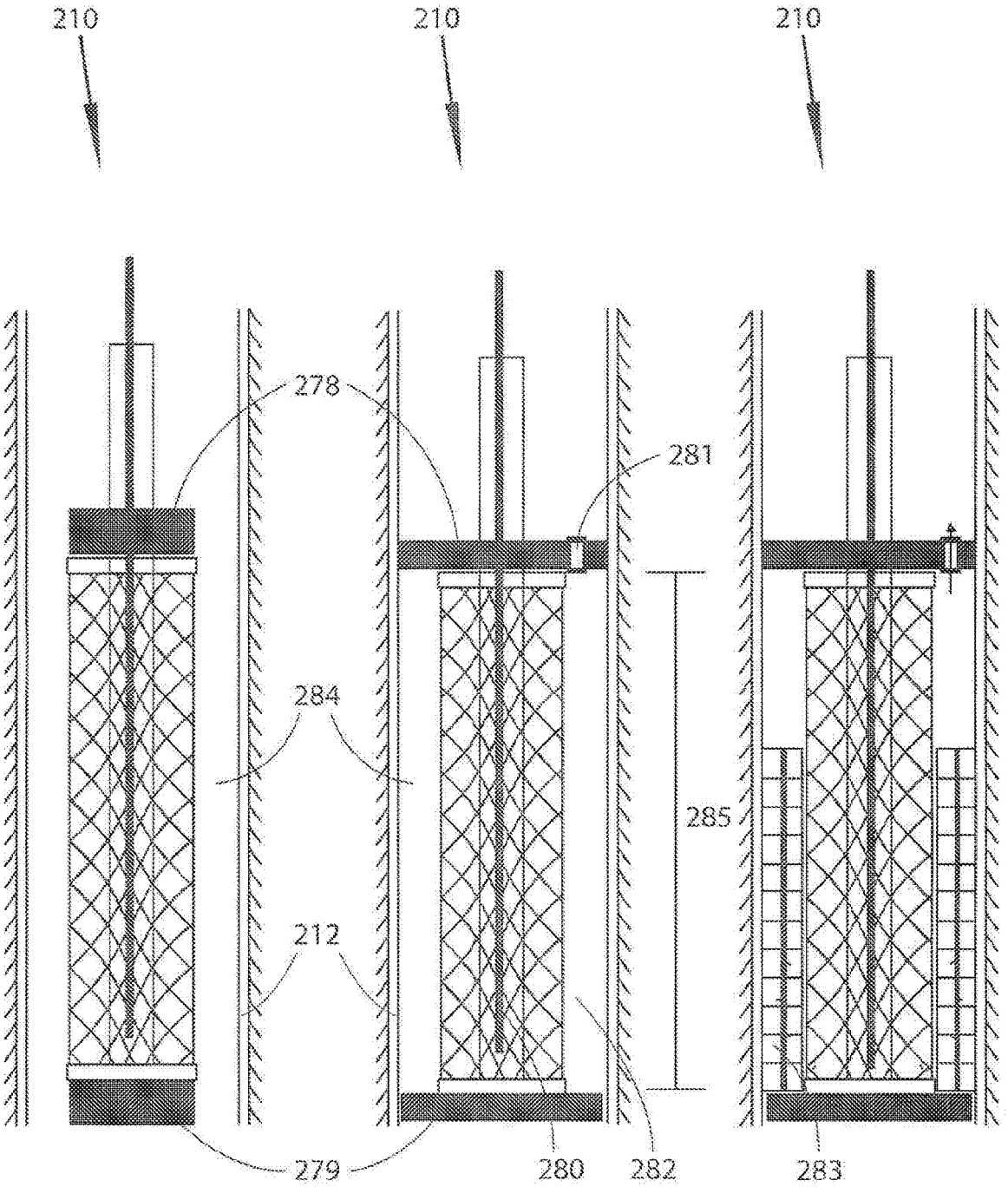
FIGS. 7A, 7B and 7C, is a series of schematic sections of a tool, in the tubular, according to a third embodiment of the present invention, the Figures illustrating shows a method of modifying the conditions around the tool to optimise the detonation conditions.

FIG. 7, comprising FIGS. 7A, 7B and 7C, shows schematic sections of a tool generally indicated by reference numeral 210 are shown in the tubular 212, according to a third embodiment of the present invention, the Figures illustrating a method of modifying the conditions around the tool 210 to optimise the detonation conditions. It will be noted that common features between this embodiment and previous embodiments of the same two digit reference numeral are preceded by the numeral 2.

The tool 210 of this embodiment incorporates an upper packer seal 278 and a lower packer seal 279. When the tool 210 is in position, as shown in FIG. 7A, it is surrounded by well fluid 284. The upper and lower packers 278, 279 are brought into engagement with the tubular internal surface 228 to seal a section 285 of the tubular 212 corresponding to the length of the lattice 216 of linear shaped charges 218. The expansion of the upper packer 278 opens a one-way valve 281 in the packer 278.

The tool 210 further includes a port 280 through which liquid foam 282 is released adjacent the lower packer 279 (FIG. 7B).

The liquid foam 282 solidifies in to a solid closed cell foam 283 which works its way up the sealed section 285 towards the upper packer 278. As the foam 283 climbs, it drives the fluid 284 out of the sealed section 285 through the check valve 281.

Once the foam 283 has filled the sealed section 285 the conditions surrounding the tool 210 are not dependent on the well conditions and optimised performance of the linear shaped charges 218 can be achieved.

Figures 8A, 8B, 8C:
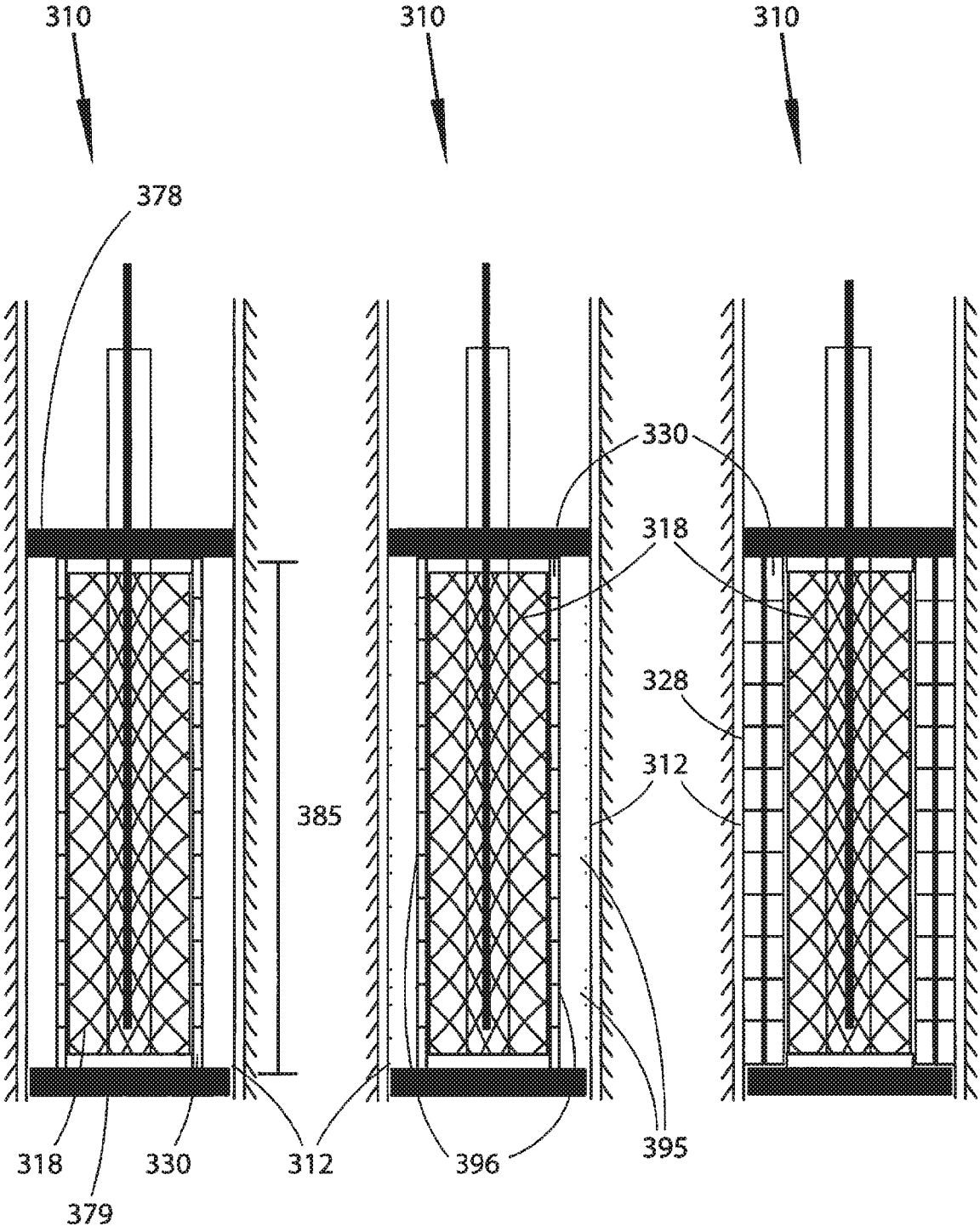
FIGS. 8A, 8B and 8C, is a series of schematic sections of a tool in the tubular, according to a fourth embodiment of the present invention, the Figures illustrating a method of modifying the conditions around the tool to optimise the effect of the linear shaped charges.
Figure 9A:
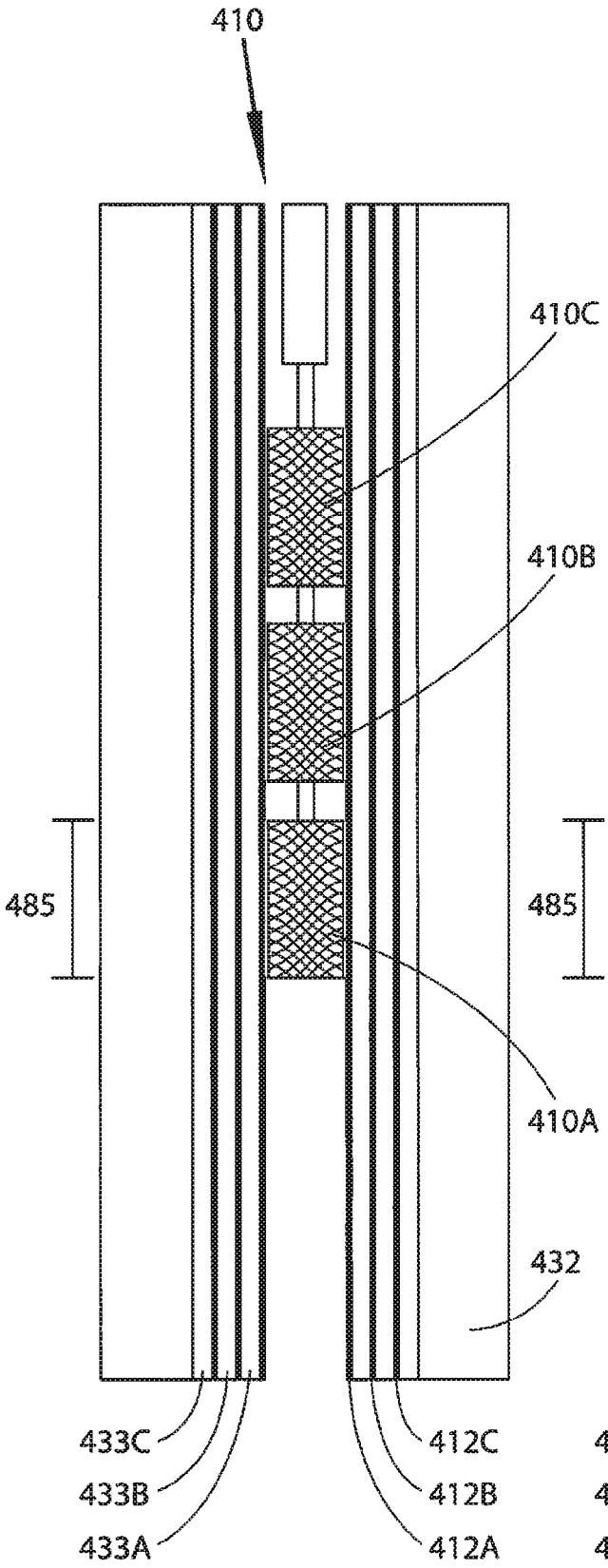
FIGS. 9A, 9B, 9C and 9D, is a series of schematic sections of a modular tool according to a fifth embodiment of the present invention, illustrating a method of removing multiple layers of tubular.
Figure 9B:
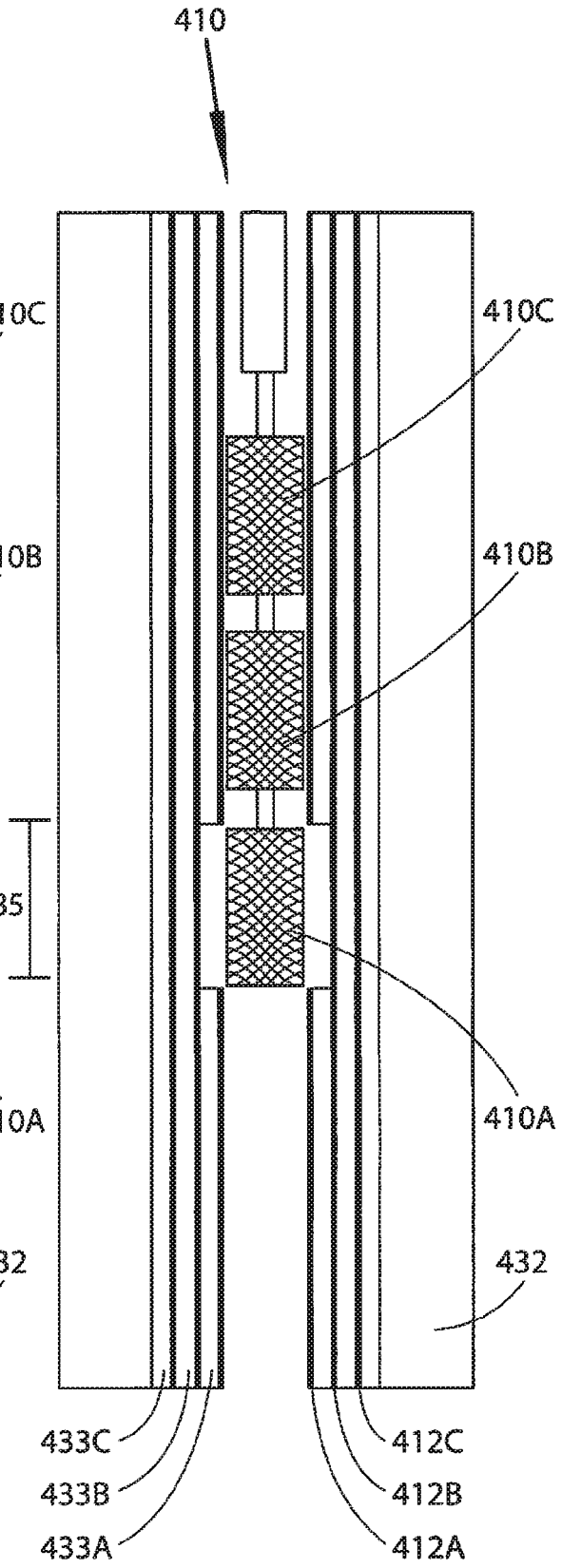
Figure 9C:
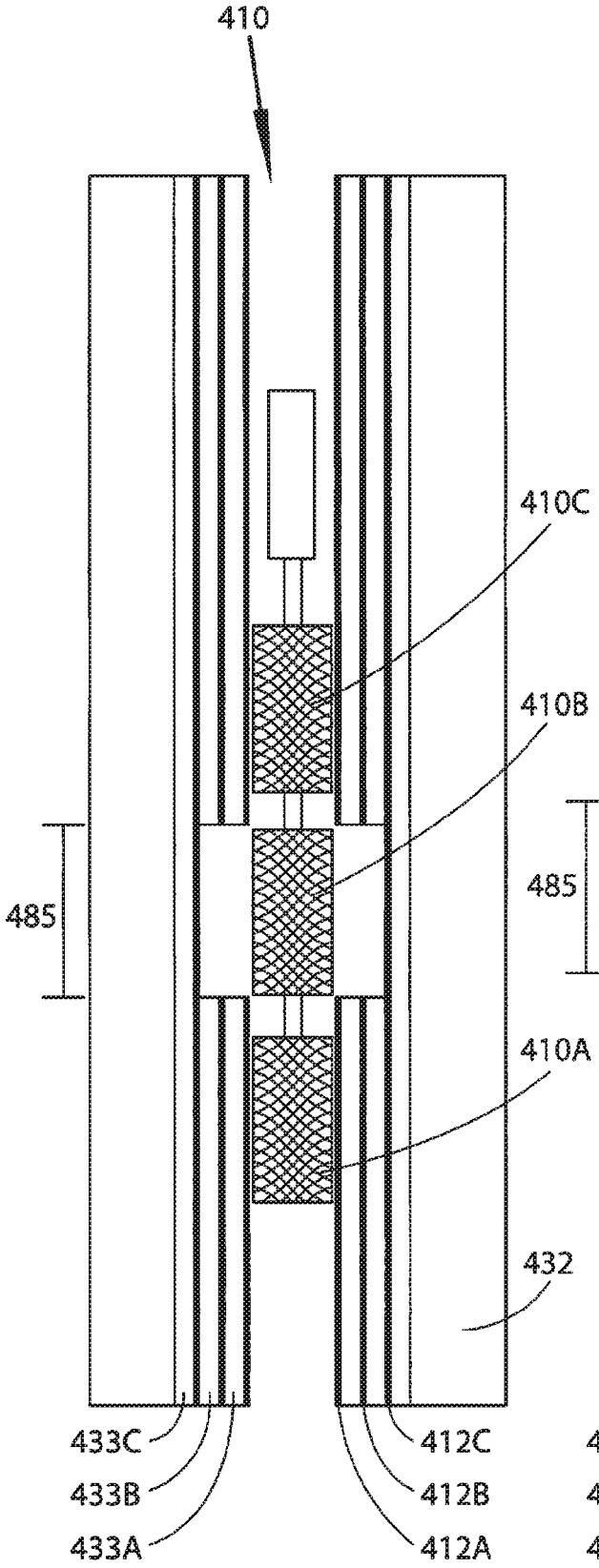
Figure 9D:
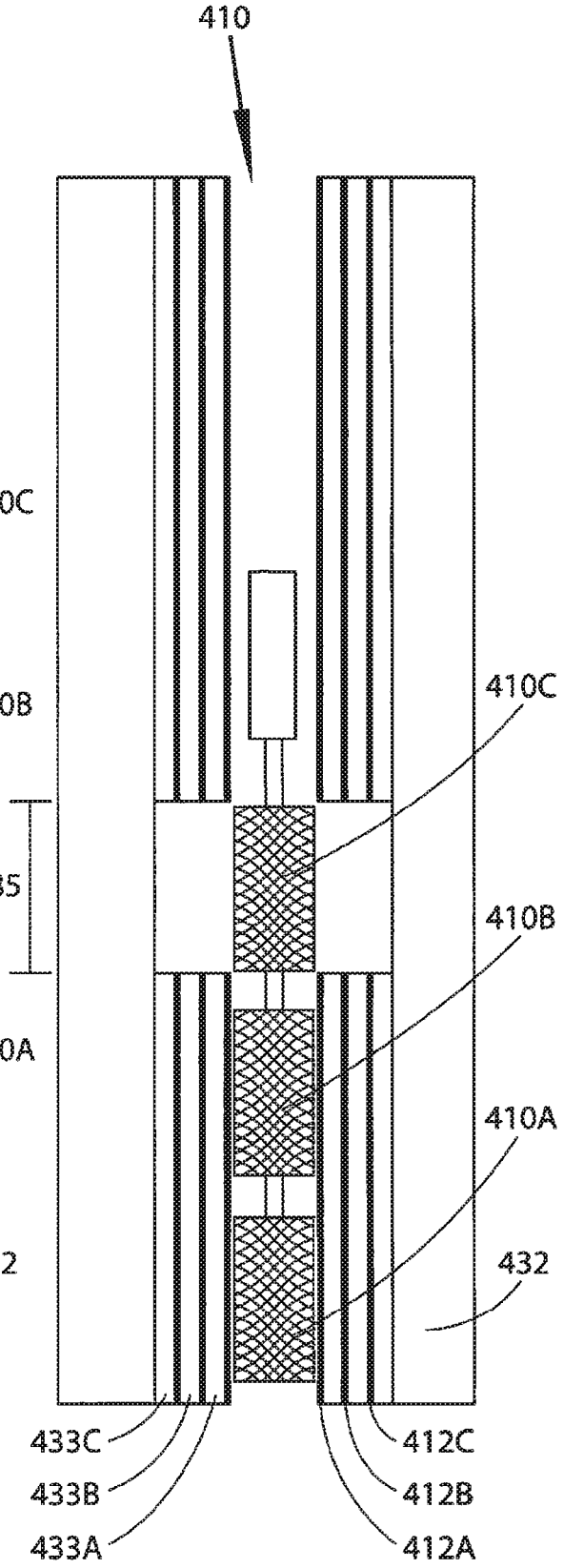

FIG. 8, comprising FIGS. 8A, 8B and 8C, shows schematic sections of a tool, generally indicated by reference numeral 310, in the tubular 312, according to a fourth embodiment of the present invention, the Figures illustrating a method of modifying the conditions around the tool 310 to optimise the effect of the linear shaped charges 318. It will be noted that common features between this embodiment and previous embodiments of the same two digit reference numeral are preceded by the numeral 3.

In this embodiment the tool 310 includes an expandable foam sleeve 330 mounted around the lattice 316 of linear shaped charges 318. The expandable foam sleeve 330 has dual function; the first is to protect the tool prior to detonation of the linear shaped charges 318 as will be described and the second, similar to the second embodiment, is to provide optimum environmental conditions through which the detonated linear shaped charges 318 can travel to obtain best possible results upon impact with the tubular 312.

Referring to FIG. 8A, when the tool 310 is in position and the upper and lower packer seals 378, 379 are set, well fluid is pumped out of the sealed section 385 and replaced with gas.

Referring to FIG. 8B, liquid nitrogen 395 is introduced into the sealed section through ports 396 in the expandable foam sleeve 330 and directed towards the tubular 312. This reduces the temperature of the tubular 312, making the tubular more brittle and easier for the linear shaped charges 318 to penetrate and shatter upon detonation.

Immediately prior to detonation, the foam 330 is expanded into contact with the tubular surface 328 and the linear shaped charges 318 are detonated (FIG. 9C), FIG. 9, comprising FIGS. 9A, 9B, 9C and 9D, shows schematic sections of a modular tool, generally indicated by reference numeral 410, according to a fifth embodiment of the present invention, the Figures illustrating a method of removing multiple layers of tubular 412A, 412B, 412C. It will be noted that common features between this embodiment and previous embodiments of the same two digit reference numeral are preceded by the numeral 4.

Looking at the Figures collectively, the modular tool 410 comprises three modules 410A, 4106, 410C intended to remove three layers of tubular 412A, 412B, 412C with associated cement 433A, 433B, 433C back to the bedrock 432 from a wellbore section 485.

As can be seen, the first module 410A is lowered into position (FIG. 9A) and then detonated (FIG. 9B) resulting in removal of the first tubular layer 412A and associated cement 433A.

The tool 410 is then lowered until the second module 410B is in position. The second module 410B is detonated (FIG. 9C) resulting in removal of the second tubular layer 412B and associated cement 433B.

The tool 410 is then lowered again bringing the third module 410C to the tubular section 485. The third module 410C is detonated (FIG. 90) resulting in removal of the third tubular layer 412C and associated cement 433C, thereby removing the tubular section 485 back to the bedrock 432.

All the above-described embodiments utilise lattice shaped configurations of linear shaped charge resulting in diamond or square fragments being cut in the tubular surface. This is not necessarily always the case as will now be shown.

With reference to FIG. 10, comprising FIGS. 10A, 10B, 10C and 10D, a method of penetrating and removing a portion of well casing according to a sixth embodiment of the present invention will be now described. It will be noted that common features between this embodiment and previous embodiments of the same two digit reference numeral are preceded by the numeral 5.

Figure 10A:
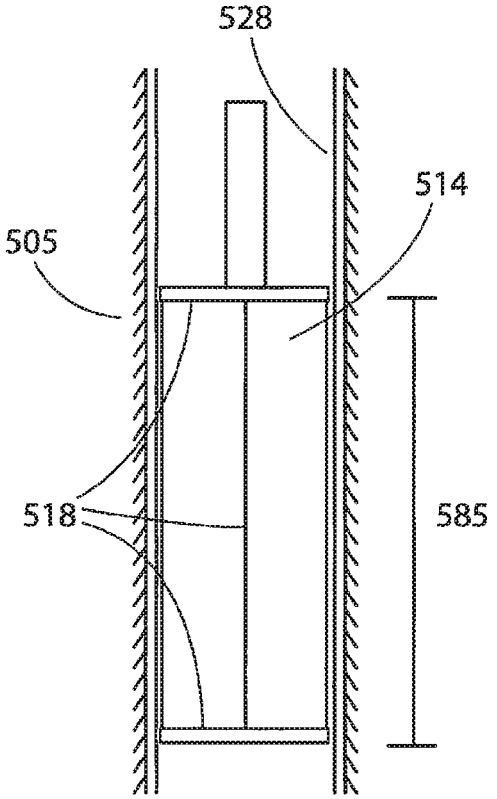
FIGS. 10A, 10B, 10C and 10D, is a series of schematic sections of a tool according to a sixth embodiment of the present invention, illustrating a method of penetrating and removing a portion of well casing.
Figure 10B:
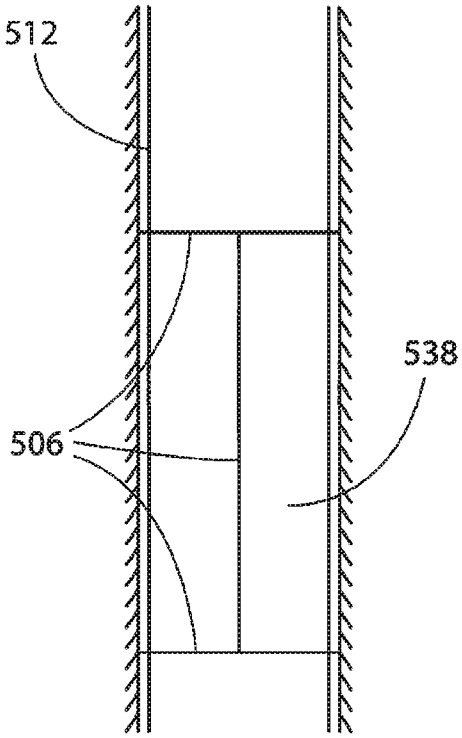

FIG. 10A represents a portion of a well 505 comprising a section 585 of tubular, in this case casing 512, and cement 533 behind the casing 512. The well 505 is to be abandoned and a cement plug to be installed in the tubular section 585.

According to this embodiment of the present invention there is provided a tool 510 which comprises lengths of linear shaped charge 518, a carrier 514 adapted to support the linear shaped charges 518, and a detonation mechanism (not visible) for detonating the linear shaped charge 518 such that, upon detonation of the linear shaped charges 518, a length of material is projected outwardly from the linear shaped charges 518 towards the casing internal surface 528 which is thereby penetrated.

As previously described, each length of linear shaped charge 518 is arranged such that, upon detonation, the trajectory of at least one portion of the projected length of material (not shown) intersects the trajectory of at least one other portion of projected length of material (not shown) at or adjacent to the casing internal surface 528.

In FIG. 10A the tool 510 has been run into the casing 512 at a desired location. The tool 510 comprises three lengths of linear shaped charge 518 embedded into the carrier 514 which comprises a cylindrical elongated stainless steel body in which two horizontal grooves and a vertical groove have been milled to embed the lengths of linear shaped charge 518. The tool 510 is deployed by a wireline (not shown).

The detonation mechanism (not shown) is arranged to detonate the three lengths of linear shaped charge 518 simultaneously.

The lengths of linear shaped charge 518 comprise V shaped copper lining, arranged such that the concave part of the charge is directed perpendicularly outwards from the carrier 514.

After detonation (FIG. 10B), the casing 512 has been penetrated by the copper lining projected by the linear shaped charges 518. The tool 510 has been retrieved to surface and the casing 512 is left with intersecting penetrations 506 produced by the material projected from the linear shaped charges 518. The penetrations 506 go all the way through the casing 512 and have cut a fragment of the casing 538.

Figure 10C:
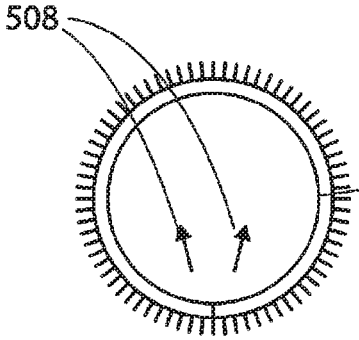
Figure 10D:
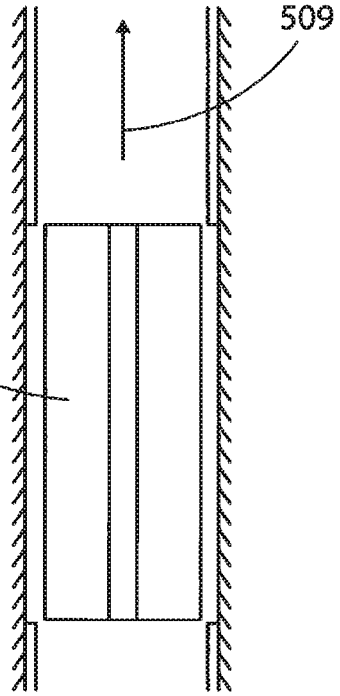

FIGS. 10C and 10D show the fragment of casing 538 from an upper view. In order to remove the fragment of casing 538 from its original location, the fragment of casing 538 is pierced and pulled inwards as the arrows 508 show, so that the diameter of the fragment of casing 538 is reduced. After that, as shown in FIG. 10D, the fragment of casing 538 can be removed by pulling upwards towards the exterior of the well, as shown by the arrow 509.

Figure 11A:
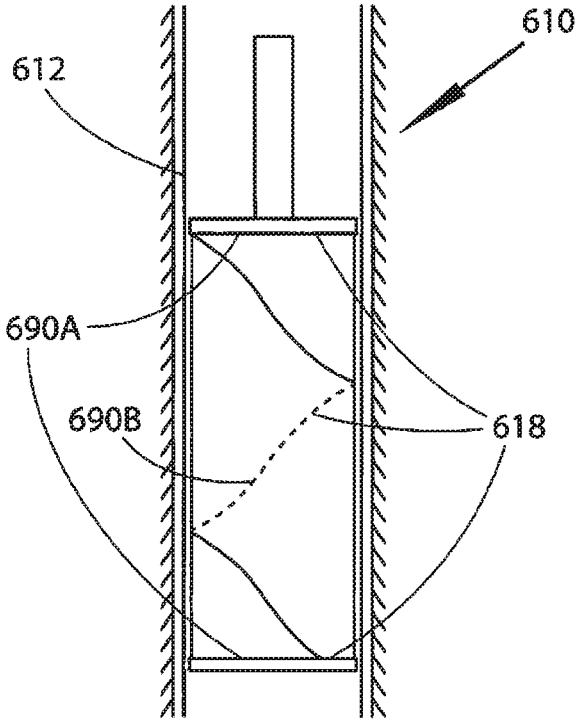
FIGS. 11A, 11B and 11C, is a series of schematic sections of a tool according to a seventh embodiment of the present invention, illustrating a method of penetrating and removing a portion of well casing.
Figure 11B:
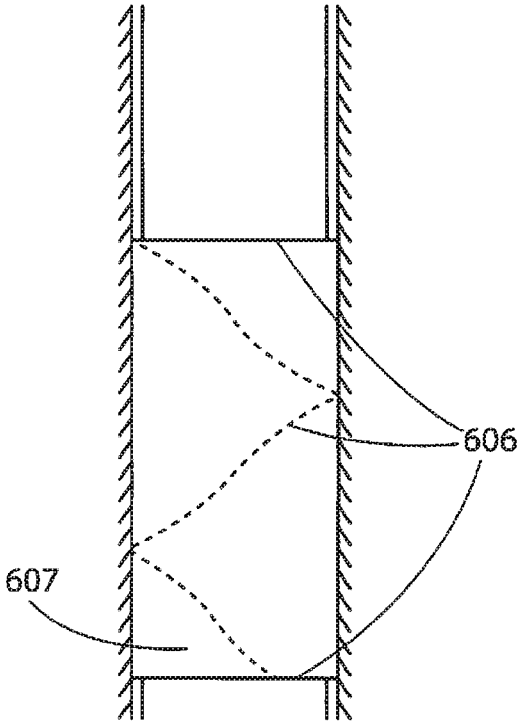
Figure 11C:
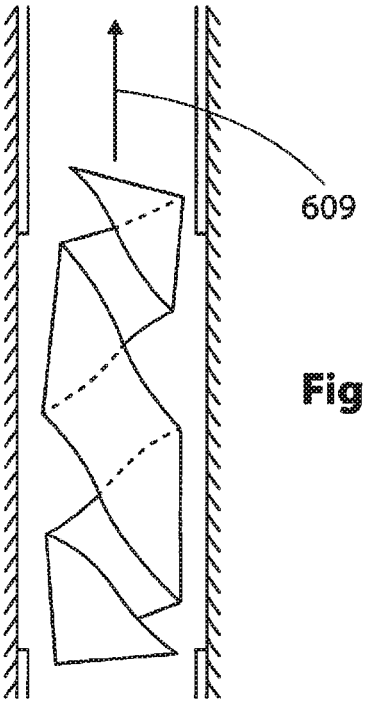

With reference to FIG. 11, comprising FIGS. 11A, 11B and 11C, a method of penetrating and removing a portion of well casing according to seventh embodiment of the present invention will be now described. It will be noted that common features between this embodiment and previous embodiments of the same two digit reference numeral are preceded by the numeral 6.

In FIG. 11A the tool 610 has been run into the casing 612 at a desired location. The tool 610 comprises three lengths of linear shaped charge 618 embedded into the carrier 614 which comprises a cylindrical elongated stainless steel body in which two horizontal grooves 690A and a helical groove 690B have been milled to embed the lengths of linear shaped charge 618. The tool 610 is deployed by a tubing string (not shown).

The detonation mechanism (not shown) comprises three detonators arranged to detonate the three lengths of linear shaped charge 618 successively.

The lengths of linear shaped charge 618 comprise V shaped copper lining, arranged such that the concave part of the charge is directed perpendicularly outwards from the carrier 614.

After detonation (FIG. 11B), the casing 612 has been penetrated by the copper lining projected by the linear shaped charges 618. The tool 610 has been retrieved to surface and the casing 612 is left with intersecting penetrations 606 produced by the material projected from the linear shaped charges 618. The penetrations 606 go all the way through the casing 612 and have cut a fragment of the casing 607.

FIG. 11C shows the fragment of casing 607 being removed from its original location. In order to do that, the fragment of casing 607 is pierced and rolled inwards like a scroll, so that the diameter of the fragment of casing 607 is reduced. After that, the fragment of casing 607 can be removed by pulling upwards towards the exterior of the well, as shown by the arrow 609.

Figure 12:
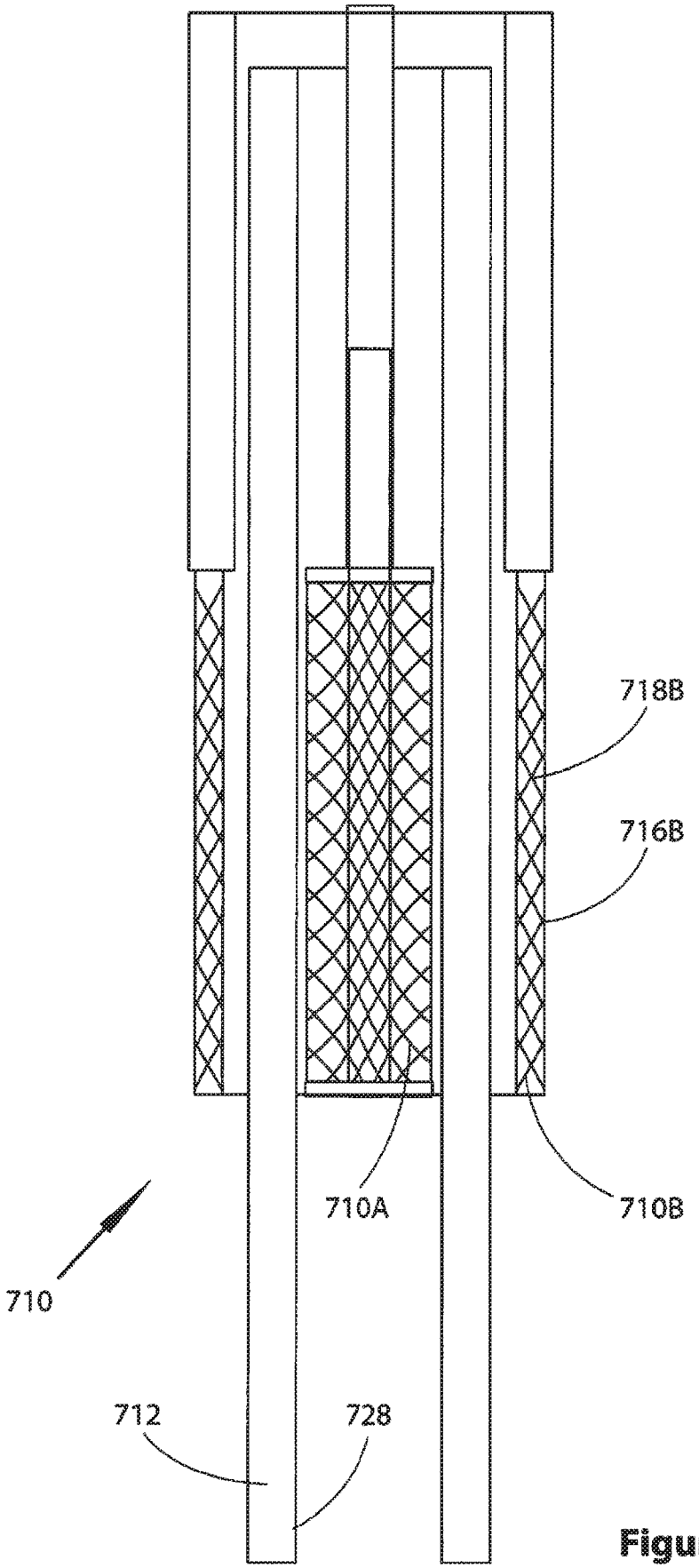
FIG. 12 is a section view of a tool for penetrating both the internal and external surface of a tubular according to an eighth embodiment of the present invention, illustrating a method of penetrating and removing a portion of tubular.

Reference is now made to FIG. 12, a section view of a tool, generally indicated by reference numeral 710, for penetrating both the internal and external surface of a tubular 712 according to an eighth embodiment of the present invention. It will be noted that common features between this embodiment and previous embodiments of the same two digit reference numeral are preceded by the numeral 7.

This tool 710 has an internal section 710A which operates in a similar fashion to the tool 10 of the first embodiment to penetrate the internal surface 728 of the tubular 712. However this tool further includes a second lattice arrangement 716B of linear shaped charges 718B arranged around an external surface 794 of the tubular 712. These linear shaped charges 718B are arranged to detonate radially inwards towards the external tubular surface 794, resulting in the tubular 712 been penetrated from its internal and external surfaces 728, 794.

Various modifications and improvements may be made to the above described embodiments without departing from the scope of the invention. For example, although the embodiments describe the uses related to removal of casing in wells, it will be understood there are other applications. For example, the tool could be used to cut a window in a tubular, the window may be a sidetrack window.

The tool also may be used to split a tubular such as production tubing along predetermined lines, then expand the split sections outwards onto or in proximity to neighbouring casing and then make a final set of cuts through the production tubing and the casing simultaneously or sequentially.

The invention claimed is:

1. A tool for penetrating a tubular, the tool comprising:

at least one length of linear shaped charge, a carrier adapted to support the or each length of linear shaped charge;

a housing in the form of a sleeve surrounding the carrier and the at least one length of linear shaped charge, to protect the at least one length of linear shaped charge;

a centralizing means to centralize the tool within a said tubular; and at least one detonation mechanism for detonating the or each length of linear shaped charge such that, upon detonation of the or each length of linear shaped charge, a length of material is projected outwardly from the or each length of linear shaped charge towards an internal surface of the tubular, which is thereby penetrated;

characterised in that at least a portion of at least one length of linear shaped charge is oriented such that said material is projected towards the internal surface of the tubular, at an angle that is oblique to the internal surface of the tubular, and in that the at least one length of linear shaped charge is arranged such that, following centralization of the tool within the tubular by use of the centralizing means, and upon detonation, the trajectory of the projected portion of the projected material intersects the trajectory of at least one other portion of projected material, from the or each length of linear shaped charge, at or adjacent the internal surface of the tubular.

2. A tool according to claim 1, wherein at least one portion of the or each length of linear shaped charge is arranged to, individually or in combination, cause penetrations that define closed areas or shapes on the surface of the tubular.

3. A tool according to claim 1, wherein there are a plurality of linear shaped charges.

4. A tool according to claim 3, wherein the tool comprises a plurality of linear shaped charges helically wound around the carrier, the plurality of linear shaped charges being helically wound clockwise and counter-clockwise around the carrier to create a lattice.

5. A tool according to claim 1, wherein at least one portion of a length of linear shaped charge overlaps another portion of the same linear shaped charge or a portion of another linear shaped charge.

6. A tool according to claim 1, wherein at least a portion of at least one length of linear shaped charge is oriented such that outwardly projected material is projected perpendicular to the surface of the tubular.

7. A tool according to claim 1, wherein there are a plurality of linear shaped charges and at least two of said linear shaped charges are detonated substantially simultaneously.

8. A tool according to claim 1, wherein, where the carrier is configurable between a first position in which the tool defines a reduced diameter and a second position in which the tool defines a larger diameter.

9. A tool according to claim 1, wherein at least one portion of the or each length of linear shaped charge is embedded in the carrier.

10. A tool according to claim 1, wherein the tool further comprises a tubular engagement mechanism adapted to apply a force to the tubular.

11. A tool according to claim 1, wherein the linear shaped charge or charges form a diamond or square shaped lattice formation, and wherein the tool further comprises an additional shaped charge or charges; and wherein the additional shaped charges are arranged to produce penetrations through the centre of the squares or diamonds.

12. A tool according to claim 1, wherein the tool is modular; and comprises one or more modules that are either:

detonated simultaneously with at least one other module; or one or more modules are detonated in a sequence with at least one other module.

13. A tool according to claim 1, wherein the tool comprises at least one optimising mechanism for optimising the performance of the tool, the optimising mechanism changing the physical characteristics of the tubular by reducing the temperature of the tubular.

14. The tool according to claim 1 wherein the housing protects the at least one linear shaped charge from external pressure and/or temperature until detonation.

15. A method of penetrating a section of tubular, the method comprising:

providing a tool which comprises at least one length of linear shaped charge, a carrier adapted to support the or each length of linear shaped charge a housing in the form of a sleeve surrounding the carrier and the at least one length of linear shaped charge, to protect the at least one length of linear shaped charge, a centralizing means to centralize the tool within a said tubular, and at least one detonation mechanism for detonating the or each length of linear shaped charge such that, upon detonation of the or each length of linear shaped charge, a length of material is projected outwardly from the or each length of linear shaped charge towards an internal surface of the tubular, which is thereby penetrated, wherein at least a portion of at least one length of linear shaped charge is oriented such that said material is projected towards the internal surface of the tubular, at an angle that is oblique to the internal surface of the tubular, wherein the or each length of linear shaped charge is arranged such that, upon detonation, the trajectory of the at least one portion of the projected material, from the or each length of linear shaped charge, intersects the trajectory of at least one other portion of projected material at or adjacent the internal surface of the tubular;

running the tool into the tubular to a desired location;

centralizing the tool by use of the centralizing means; and detonating at least one portion of the or each length of linear shaped charge.

16. The method according to claim 15 further comprising the step of either:

applying a tension to the tubular before detonating the at least one portion of linear shaped charge; or applying a compression to the tubular before detonating the at least one portion of linear shaped charge.

* * * * *